US005469941A

United States Patent [19]

Horvath

[11] Patent Number: 5,469,941

[45] Date of Patent: Nov. 28, 1995

[54] AUTOMATIC HANDBRAKE RELEASE SYSTEM FOR A RAILROAD CAR

[75] Inventor: Robert L. Horvath, O'Fallon, Ill.

[73] Assignee: James T. Williamson, Alton, Ill.

[21] Appl. No.: 192,349

[22] Filed: Feb. 7, 1994

[51] Int. Cl.[6] ..... F16D 65/14

[52] U.S. Cl. ..... 188/107; 188/47

[58] Field of Search ..... 188/107, 42; 303/9.61, 303/74, 76, 86

[56] References Cited

U.S. PATENT DOCUMENTS

| | | | |
|---|---|---|---|
| Re. 34,040 | 8/1992 | Rains | 188/47 |
| 1,368,795 | 2/1921 | Haas | 74/118 |
| 1,879,971 | 1/1932 | Burnett | 188/107 |
| 1,991,330 | 2/1935 | Mitchell | 188/107 |
| 2,183,303 | 12/1939 | Campbell | 303/74 |
| 4,049,088 | 9/1977 | Stjarne et al. | 188/107 |
| 4,746,171 | 5/1988 | Engle | 188/107 |
| 4,805,743 | 2/1989 | Rains | 188/47 |
| 4,978,178 | 12/1990 | Engle | 188/107 |
| 5,201,890 | 4/1993 | Sauer et al. | 188/107 |

*Primary Examiner*—Matthew C. Graham
*Attorney, Agent, or Firm*—Don W. Weber

[57] ABSTRACT

A system is presented for automatically releasing all handbrakes of a railroad freight car or passenger car system. Working from the main air brake pressure lines, a pressure switch is provided which trips once the air pressure for the separate air brake system of a freight train or passenger train is reached. This pressure switch in turn energizes another mechanism, either a piston or other internal types of mechanical connection, which then pushes up the brake lever release releasing the handbrake. Since each handbrake on each end of each car is connected to the main air brake system through pressure sensitive valves, all manual handbrakes are released on all cars once the air pressure of the train is brought up to a certain level.

3 Claims, 2 Drawing Sheets

AUTOMATIC HANDBRAKE RELEASE SYSTEM FOR A RAILROAD CAR

BACKGROUND OF THE INVENTION

This invention relates to the field of railroad train cars. More particularly, it relates to an automatic handbrake release for a railroad car.

In the railroad industry two sets of brakes are used to stop railroad freight cars. The train is operated principally on an air pressure brake system. Air pressure is built up in the engine which in turn pressurizes the air brake system for each train car. This main air pressure line is connected from car to car by means of individual car hook-ups. Once the train air pressure reaches approximately 70–90 psi, the air brake system for each car is then energized and operable. A second and hereto separate handbrake system is also utilized on each car.

Each railroad freight car is also equipped with a single separate handbrake or a pair of handbrakes, one handbrake being at each end of the car. The handbrake is manually operated and may be set despite the existence of air pressure on the train car or the movement of the train. These handbrakes are set to operate individually from each other and individually from each other car on the railroad train.

One problem frequently encountered in the railroad industry is the problem of moving the train while one or more handbrakes are still set in the braked position. This could occur due to the negligence of the operators of the railroad train itself or due to other reasons. When the train is pulled with one or more handbrakes set, the metal wheels of the railroad car will be caused to flatten as they are dragged along the metal railroad track without the wheels turning. This flattening of the wheels is a dangerous condition and is very expensive to remedy since the entire wheel must then be removed from the freight car and replaced.

One invention directing toward reducing the risk of moving the train while one or more handbrakes is set is described in the 1993 patent issued to Sauer, U.S. Pat. No. 5,201,890. In the Sauer patent, a standard type handbrake has affixed to each of the handbrake units a hydraulic cylinder. A pair of hydraulic cylinders are interconnected for each car so that releasing the brake at one end of the car will also actuate the release for the handbrake unit at the other end of the car. Return springs automatically return the release handles at both ends to their non-actuated positions. While this particular device precludes having both handbrakes in the locked position as the car is pulled, it would insure that both handbrakes are released if only one handbrake at one end of the car is manually released. However, Sauer does not provide for the simultaneous and automatic release of all handbrakes once one mechanism is released.

It is an object of this invention to provide a simple yet automatic system for releasing the entire handbrake system of a railroad train once a pre-determined pressure is reached on the train's separate air brake system. Another object of this invention is to insure that a railroad train is not run with any of the manual handbrakes on the individual cars in the locked position.

A still further object of this invention is to provide a means for reducing wear on railroad wheels by automatically insuring that the train's air brake system will automatically release the separate handbrake systems once a set running pressure is achieved. Other and further objects of this invention will become apparent upon reading the below described Specification.

BRIEF DESCRIPTION OF THE DEVICE

An automatic handbrake release system is provided that is energized from the air pressure of the railroad air brake system. Automatic release pistons are affixed to each handbrake at each end of a railroad car such that when the piston is pressurized it will automatically release the manual handbrake which was previously set. The handbrake release piston is connected to the main air pressure system for the separate air brake system of a railroad car. The piston air line is connected to the main air brake system through a pressure sensitive switch. This pressure sensitive switch trips once the main air line system reaches a pressure of approximately 70 psi. When the air brake system reaches the operating pressure of 70 psi, the manual handbrake lever piston is extended and the manual handbrake is automatically released. A second bleeder valve is also available to remove the handbrake release piston from the entire system when desired.

When the train air brake main system reaches its desired operating pressure, all manual handbrakes are simultaneously and automatically released. The handbrakes are tightened manually. Provision is made for removal of the handbrake piston from the system should that be desired.

DETAILED DESCRIPTION OF THE PREFERRED EMBODIMENT

Figure 1:
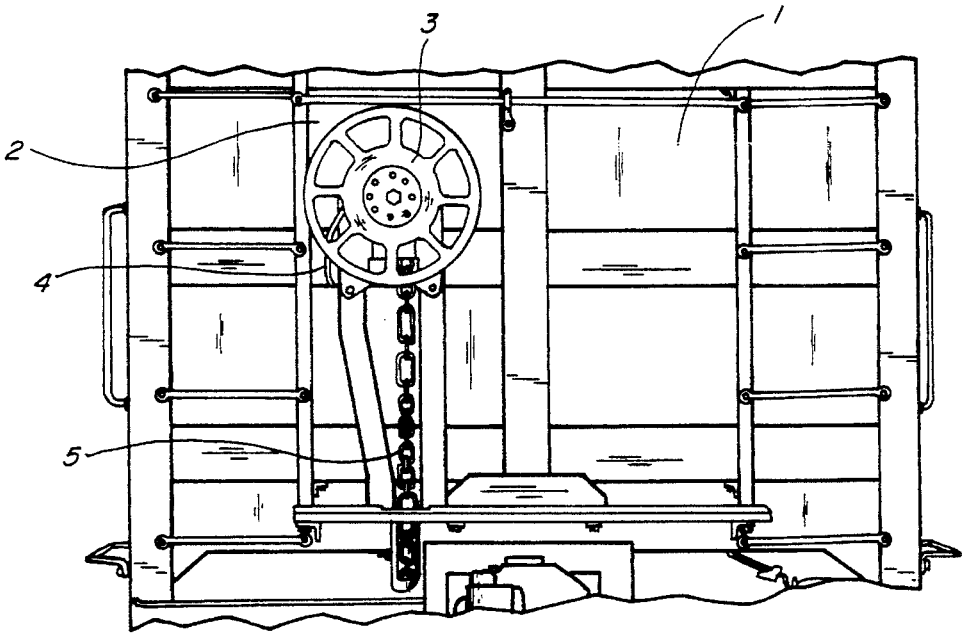
FIG. 1 is a close-up front view of the end of a railroad car showing the manual handbrake system.

An automatic means for releasing the manual handbrake of a railroad car is presented. As best shown on FIG. 1, the manual braking system is shown generally at 2. This manually operated brake system comprises essentially a tightening wheel 3, a releasing lever 4, and a force applying chain 5. When the wheel is rotated in a clockwise direction, the chain 5 is retracted and the brake is applied to the wheels directly below the manual handbrake system. In order to release this handbrake, one simply pulls upwardly on the releasing lever 4 which releases the tension on the chain and thus releases the brake.

Figure 2:
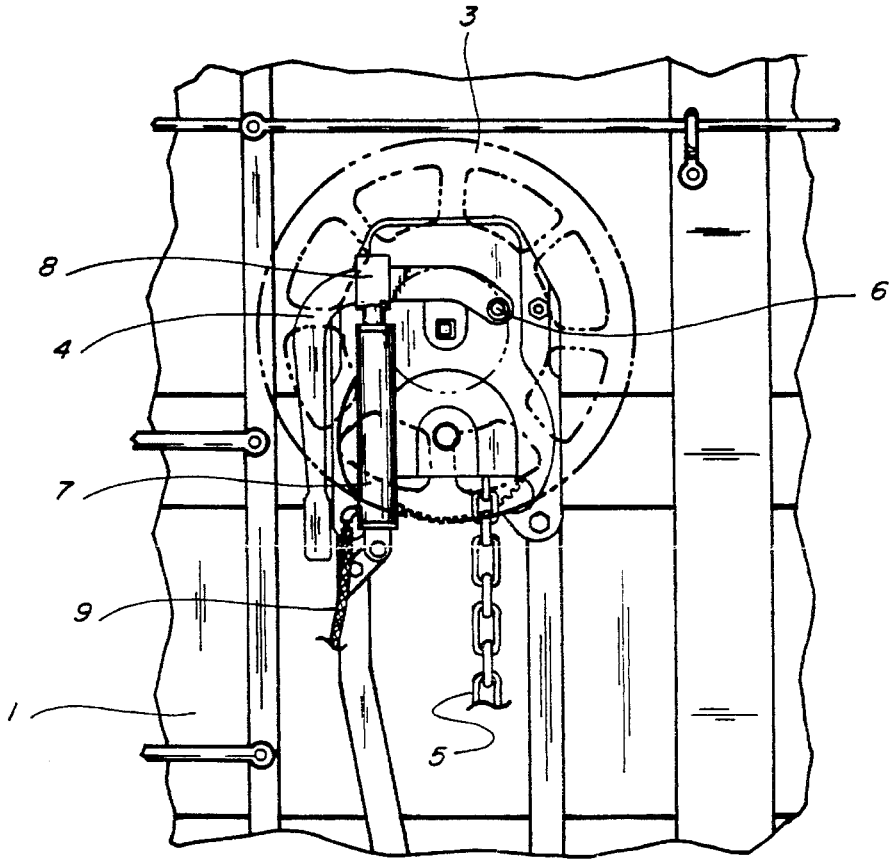
FIG. 2 is a detailed view of the manual handbrake system shown in FIG. 1 showing the various internal workings of the handbrake system.

Turning to FIG. 2, the internal operations of the manual handbrake system are readily determined. The tightening wheel 3 tightens the chain 5 to produce tension on the brake system delivered to the wheels. The chains are held in a taut position by means of the gear and pawl system shown on FIG. 2. The operation and tightening mechanism of the manual brake system for a railroad car is well-known in the art being generally described in the 1993 patent issued to Sauer (U.S. Pat. No. 5,201,890) and others.

Figure 3:
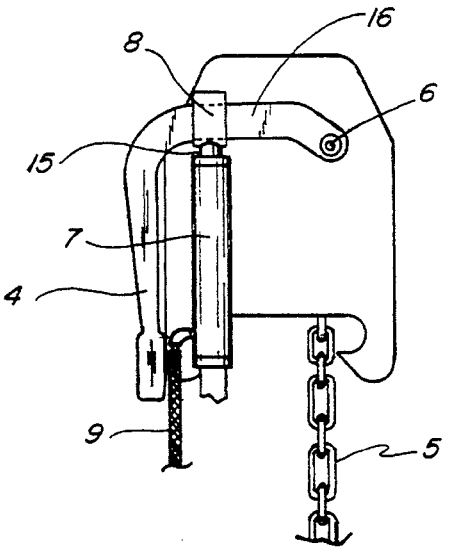
FIG. 3 is a front isolated view of the manual handbrake system showing the handbrake release lever, piston, and air pressure supply line, with the lever is in the locked position.

The releasing lever 4, shown in the braked position on FIG. 2, pivots about releasing lever pivot point 6. When the lever is in the position shown in FIG. 3, the manual brake is engaged and the chain 5 is taut. When the lever is lifted as shown in the lever position 4' on FIG. 4, the tightening chain 5 is released from its tension and the manual brake system for the railroad car is then released. The releasing lever piston 7 is introduced into the manual brake system according to the practice of this invention in order to automatically release the releasing lever 4 or 4' once a certain set pressure is achieved in the main line air brake system.

Figure 4:
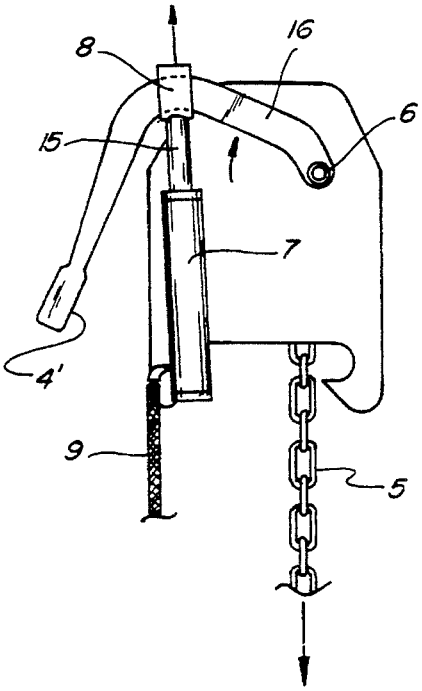
FIG. 4 is a detailed view similar to FIG. 3 showing the handbrake release lever in the unlocked or released position.

Attached to the standard manual brake release system 2 of a freight car 1 is a releasing lever piston 7. This piston is attached as best shown on FIG. 2 such that the top 15 of the piston rod is in contact with the horizontal portion 16 of the releasing lever 4. At the top of the piston rod 15 is located a releasing lever piston saddle 8. This saddle 8 is designed so that the piston rod 7 is in mechanical contact with the releasing lever 4. When the piston rod is in the extended position, as best shown in FIG. 4, the releasing lever 4' is pivoted about its pivot point 6 and the tightening chain 5 is released. The piston rod 7 simulates the mechanical action required by the workman's hand to release the handbrake system 2.

Figure 5:
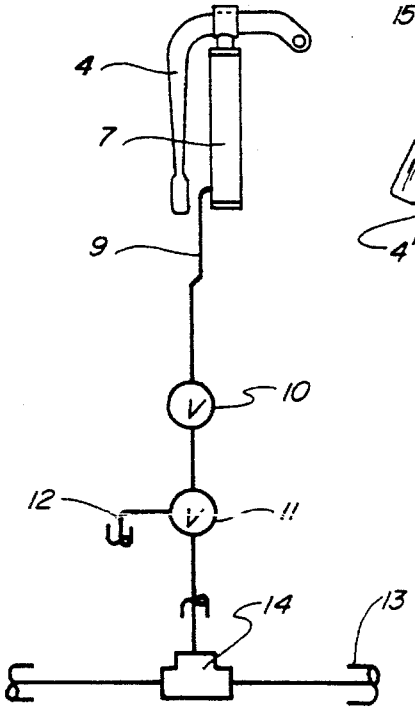
FIG. 5 is a schematic view of the handbrake release system showing the air pressure supply line to the releasing lever piston and the main air supply line to the separate train air brake system along with the switching valve and bleeder valve.

Turning to FIG. 5, the workings of the automatic manual brake release system is shown. The air brake system on a train is separate and runs throughout the train connected from car to car by the main train supply air pressure line 13. This air pressure line is connected to the automatic brake release system and releasing piston 7 by means of a train supply/piston supply pressure line connector 14. The train pressure air brake system normally operates at approximately 90 pounds. A threshold valve pressure switch 10 is located between the main train supply air pressure line 13 and the releasing piston pressure line 9. This pressure switch valve 10 is designed to open once the pressure received from the train supply air pressure line 13 is approximately 70 psi. When the 70 psi pressure is achieved, valve 10 opens and pressurizes the releasing lever piston air pressure supply line 9. This, in turn, supplies pressure to the releasing lever piston 7 which then extends from the position shown in FIG. 3 (brakes engaged) to the position shown in FIG. 4 (manual brakes released).

Figure 6:
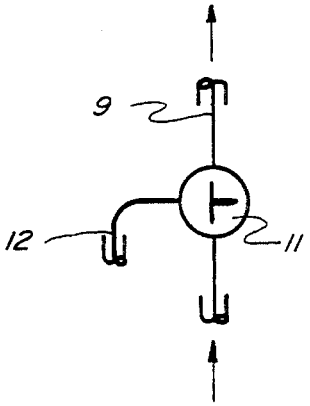
FIG. 6 is a schematic view of the bleeder valve showing the valve in the normal position.
Figure 7:
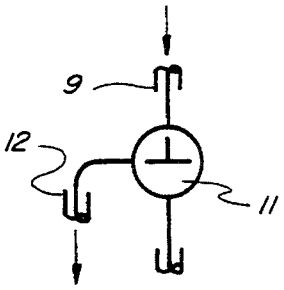
FIG. 7 is a schematic of the air pressure and bleeder valve system showing the bleeder valve in the "bleed" position which takes the released air piston out of the manual handbrake system entirely.

Should it be desired, for safety or other reasons, to completely remove the automatic brake release system from the manual brake system of the train and individual cars, a separate override valve 11 is also placed in the system between the main train supply air pressure line 13 and the pressure switch valve 10 and releasing lever piston 7. This override or bleeder valve 11 is in the normally open position shown in FIG. 6. In normal operation, air pressure from the main train supply air pressure line 13 is fed through the bleeder switch override valve 11 straight into the 70 psi pressure switch valve 10. When it is desired to remove the releasing lever piston 7 from the manual brake system, the override valve 11 is turned into the bleeder mode as shown schematically in FIG. 7. When the override valve 11 is in the bleeder mode as shown in FIG. 7, any pressure previously accumulated in the releasing lever piston 7 is drained off through the bleeder line 12. Placing the override valve 11 in the configuration shown in FIG. 7 entirely removes the automatic brake release system from the operation of the manual brake release and closes the line along which the main train supply air pressure line 13 runs.

The type of piston normally used in the preferred embodiment of this system is arranged such that the cylinder will expand to release the releasing lever once the pressure to the pressure valve 10 reaches or exceeds 70 psi. The piston then expands, releases the brake release lever, and then returns to its contracted position shown in FIG. 3. The pressure previously accumulated in the piston automatically bleeds off.

In the operation of the present invention, the air pressure supplied to the main air brakes of the train accumulates to 70–90 psi, as in the normal operating condition of the air brake system. Once train pressure reaches 70 psi or above, the brake release piston 7 pushes up the handbrake 4 to the released position 4' which releases the manual handbrake system for a railroad car. Since each handbrake on each car is connected to the main air pressure brake line 13, all handbrakes on a train are released automatically upon the train reaching the 70 psi level.

The general invention shown and described herein is meant as an illustration only and not as a limitation as to the precise means used to accomplish the automatic brake release of the multiple handbrakes on a railroad car. Obviously, mechanisms can be attached to the inside of the brake release system such that the accumulation of a set amount of air pressure could release the catch mechanism for the tensioning chain 5 by alternate means. One means would be the expansion of a piston rod to manually open the release lever 4. Another means would be to apply a smaller piston inside the catch release locking mechanism itself with the smaller system expanding and releasing the internal component tensioning system of the brake. Other means for releasing the tensioning chain 5 are well within the contemplation of this invention. What is presented is a means for automatically releasing the handbrake system of a railroad car once a set pressure in the air brake system is accomplished.

Having fully described my invention, I claim:

1. An add-on device adapted to automatically release the manual handbrake of a railroad car when pressure in the main air pressure line of a train reaches a certain level, said handbrake being released by the upward movement of a manual releasing lever, comprising:

(a) a piston having a body and an upwardly extendable piston rod, said piston adapted to be attached near said manual handbrake wherein the top of said piston rod is in mechanical contact with the manual releasing lever during operation of the piston;

(b) a piston air pressure line connecting the main air pressure line of said train to said piston;

(c) a pressure sensitive valve means located in said piston air pressure line between said main pressure line and said piston, wherein said valve means automatically opens when the air pressure in said main pressure line exceeds a set PSI level;

whereby the manual handbrake of a railroad car is automatically released by the upward extension of said piston rod, when the pressure in the main air pressure line of a train reaches a certain level.

2. An add-on device for automatically releasing the manual handbrake on a railroad car, as in claim 1, wherein said PSI level is equal to or greater than 70 PSI.

3. An add-on device for automatically releasing the manual handbrake on a railroad car, as in claim 1, further comprising an override valve means located between said main air pressure line and said piston whereby opening said override means removes the piston from the manual handbrake system.

* * * * *